US009198503B1

(12) United States Patent
Rieger

(10) Patent No.: US 9,198,503 B1
(45) Date of Patent: Dec. 1, 2015

(54) MOP WITH LOCKABLE CLAMP ARM

(76) Inventor: Rebecca J. Rieger, Boca Raton, FL (US)

( * ) Notice: Subject to any disclaimer, the term of this patent is extended or adjusted under 35 U.S.C. 154(b) by 576 days.

(21) Appl. No.: 13/592,485

(22) Filed: Aug. 23, 2012

(51) Int. Cl.

| | |
|---|---|
| ***B43K 5/04*** | (2006.01) |
| ***A46B 11/00*** | (2006.01) |
| ***A47L 13/22*** | (2006.01) |
| ***A47L 13/12*** | (2006.01) |
| ***A47L 13/10*** | (2006.01) |
| ***A47L 13/26*** | (2006.01) |
| ***A47L 13/51*** | (2006.01) |
| ***A47L 13/14*** | (2006.01) |
| ***B65B 43/42*** | (2006.01) |
| ***A47G 25/02*** | (2006.01) |
| ***A47L 13/20*** | (2006.01) |

(52) U.S. Cl.
CPC ..... *A46B 11/00* (2013.01); *A47G 25/02* (2013.01); *A47L 13/10* (2013.01); *A47L 13/14* (2013.01); *A47L 13/20* (2013.01); *A47L 13/22* (2013.01); *A47L 13/26* (2013.01); *A47L 13/51* (2013.01); *B65B 43/42* (2013.01)

(58) Field of Classification Search
USPC ..... 401/6, 140, 137–139, 190, 203, 207, 401/284; 15/119.2, 116.2, 244.2, 147.2, 15/145; 134/6
See application file for complete search history.

(56) References Cited

U.S. PATENT DOCUMENTS

| | | | | |
|---|---|---|---|---|
| 4,807,334 | A * | 2/1989 | Blanchard | 24/487 |
| 5,815,878 | A | 10/1998 | Murakami et al. | |
| 5,888,006 | A | 3/1999 | Ping et al. | |
| 5,926,896 | A * | 7/1999 | Allemann et al. | 15/147.2 |
| 6,484,346 | B2 | 11/2002 | Kingry et al. | |
| 6,687,943 | B2 * | 2/2004 | Zorzo | 15/228 |
| 7,699,551 | B2 * | 4/2010 | Suda et al. | 401/139 |
| 7,811,649 | B2 | 10/2010 | Post | |
| 2002/0056167 | A1 * | 5/2002 | Ohm et al. | 15/119.2 |

* cited by examiner

*Primary Examiner* — Paul R Durand
*Assistant Examiner* — Thomas M Abebe
(74) *Attorney, Agent, or Firm* — Crossley Patent Law

(57) ABSTRACT

A mop having a cleaning head swivelingly disposed on a handle, a base on the cleaning head, the base including pivotable lockable clamp arms with teeth disposed thereon that engage opposite side edges of a cleaning cloth to prevent slippage of the cleaning cloth away from the cleaning head.

6 Claims, 3 Drawing Sheets

MOP WITH LOCKABLE CLAMP ARM

BACKGROUND OF THE INVENTION

Various types of cleaning implements having replaceable sheets and spray nozzles are known in the prior art. However, what is needed is a mop that has pivotable lockable clamp arms with teeth that engage opposite side edges of a cleaning cloth to prevent slippage of the cleaning cloth away from a cleaning head.

FIELD OF THE INVENTION

The present invention relates to cleaning implements, and more particularly, to a mop with a lockable clamp arm.

SUMMARY OF THE INVENTION

The general purpose of the present mop with lockable clamp arm, described subsequently in greater detail, is to provide a mop with a locking clamp which has many novel features that result in a mop with a lockable clamp arm which is not anticipated, rendered obvious, suggested, or even implied by prior art, either alone or in combination thereof.

To accomplish this, the present mop with locking clamp includes a handle, a trigger attached to the handle, and an impermeable container attached to the handle for holding liquid substances such as a cleaning solution. A cleaning head is disposed on an inner end of the handle. The cleaning head has a base having a first end, a second end opposite the first end, a top side, a bottom side, a front side, and a rear side, and a protrusion centrally disposed between the first end and the second end on the top side of the base. A plurality of bristles is continuously disposed on a bottom side of the base to permit a cleaning cloth to removably cling thereto. A spray nozzle, which is disposed on a protrusion on a base front side, is in operational communication with the trigger and the container. Activation of the trigger releases a liquid substance, such as cleaning solution, into the spray nozzle which, in turn, release the liquid substance from the spray nozzle onto a surface to be cleaned. A lockable clamp arm is pivotally attached to each of a first side and a second side of the protrusion in parallel alignment with a first end and a second end of the base, respectively. Each lockable clamp arm pivots from a closed position in which the lockable clamp arm is in direct contact with a top side of the respective first end and second end toward an open position in which the lockable clamp arm is raised above the top side of the respective first end and second end. A notch is continuously disposed on an exterior end and a top wall of each lockable clamp arm. A latch is pivotally disposed within the notch on each lockable clamp arm. Each latch engages one of the lockable clamp arms into the closed position. The latch has an outside wall. A gripping surface is disposed on the outside wall to aid in the lifting of the latch. A plurality of spaced-apart teeth is continuously disposed on the top side of the base on each of the first end and the second end. A plurality of spaced-apart teeth is also continuously disposed on a bottom surface of each lockable clamp arm. The teeth can be disposed proximal to the perimeter of the first end, the second end, and each lockable clamp arm as illustrated in the drawings. The latch also allows a user to lift each lockable clamp arm without contacting the teeth.

In use, the bristles removably engage a cleaning cloth having outer ends. The user raises the lockable clamp arms into the open position. Each of the outer ends wrap over the first and second ends, of the base and over the teeth disposed between the respective lockable clamp arm and the respective first and second end, of the base. The user then lowers the lockable clamp arms into the closed position and engages the lockable clamp arms with the latch during use. The user sprays liquid substance from the container onto the surface to be cleaned by pulling the trigger to release the liquid substance through the spray nozzle and spreads the liquid substance to clean the surface with the cleaning cloth. The cleaning cloth can be removed, cleaned, and reused on the device. The cleaning cloth can also be formed of recyclable materials. When one of the cleaning cloths can no longer be used due to wear and tear, the user replaces the cleaning cloth.

The present device has a length in range of approximately 10 inches to 11 inches and a width in a range of approximately 5 inches to 6 inches, although the device can have other sizes, and can be formed in a wide range of colors.

Thus has been broadly outlined the more important features of the present mop with locking clamp so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
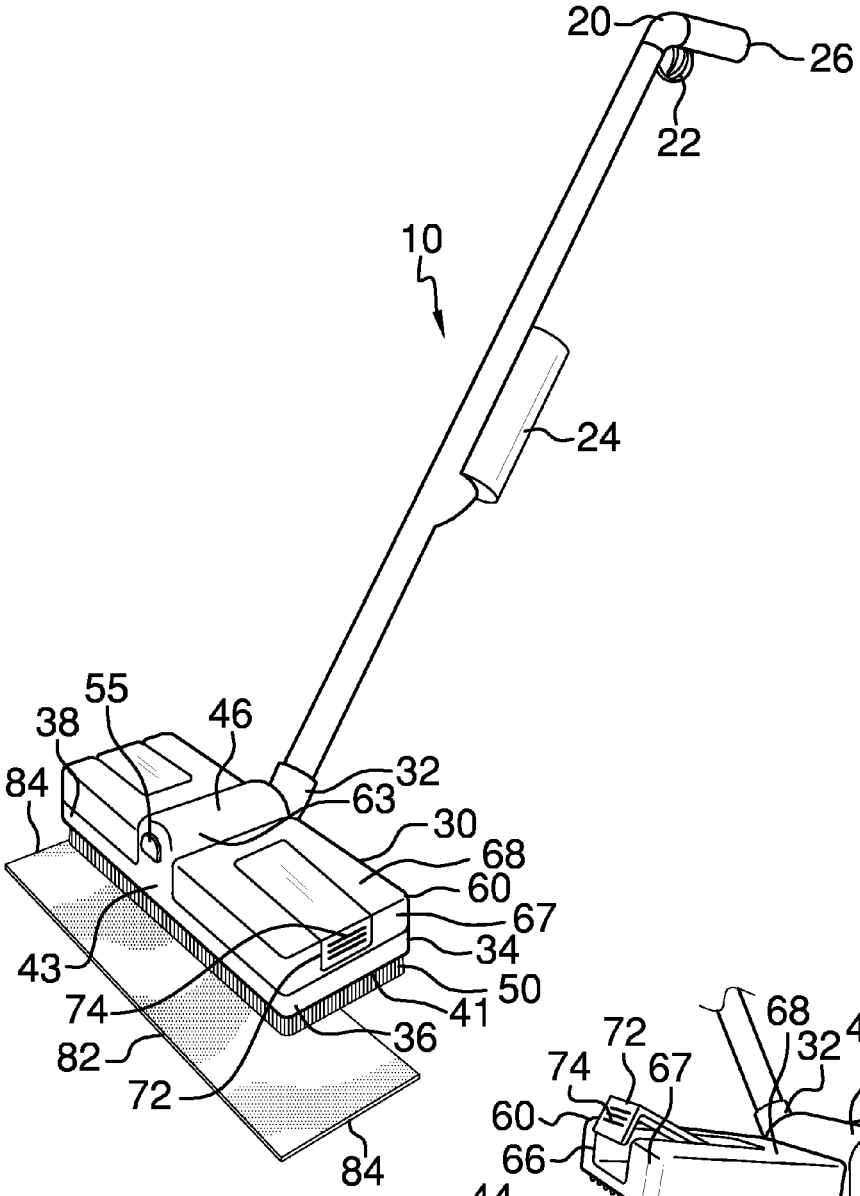
FIG. 1 is an isometric view.
Figure 2:
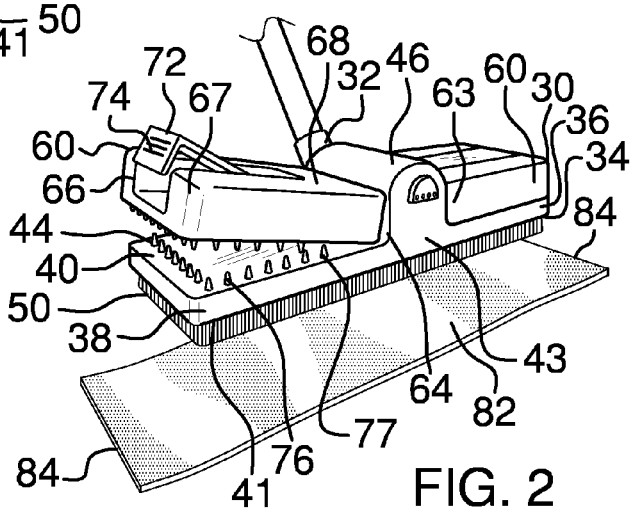
FIG. 2 is an isometric view of a cleaning head.
Figure 3:
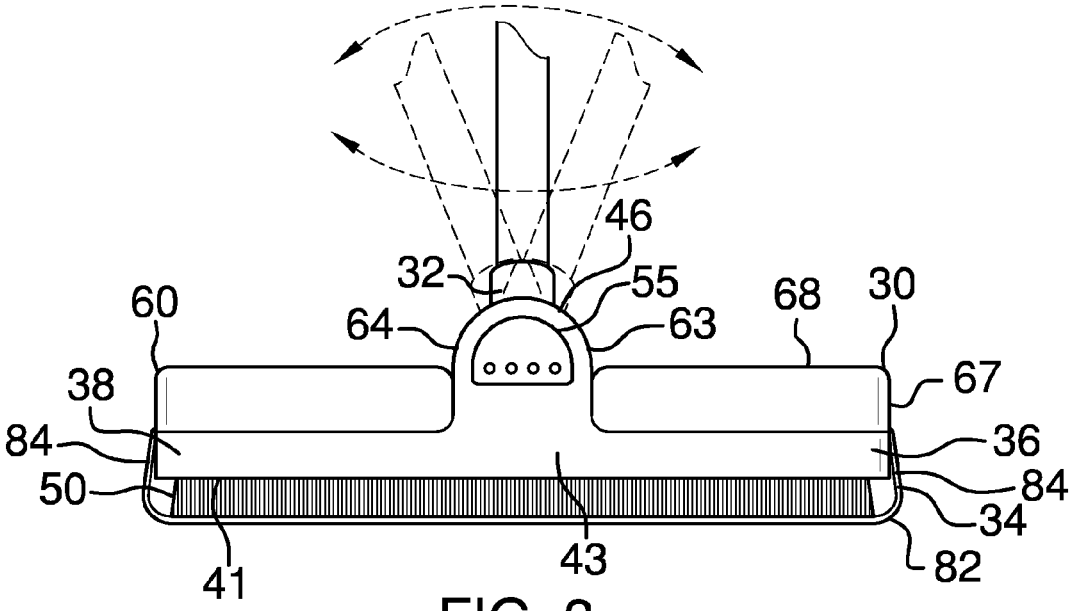
FIG. 3 is a front elevation view of the cleaning head in a closed position.
Figure 4:
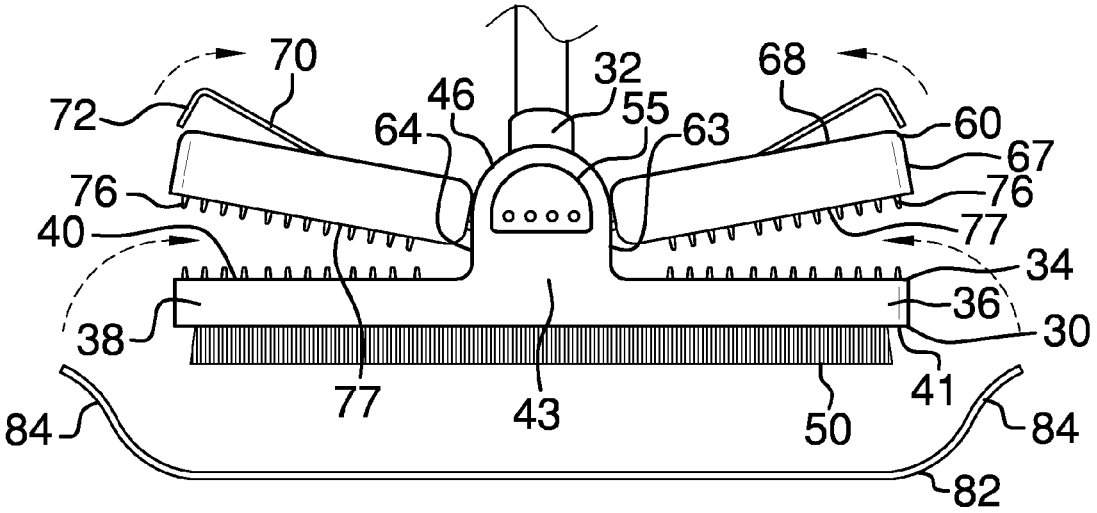
FIG. 4 is a front elevation view of the cleaning head in an open position.
Figure 5:
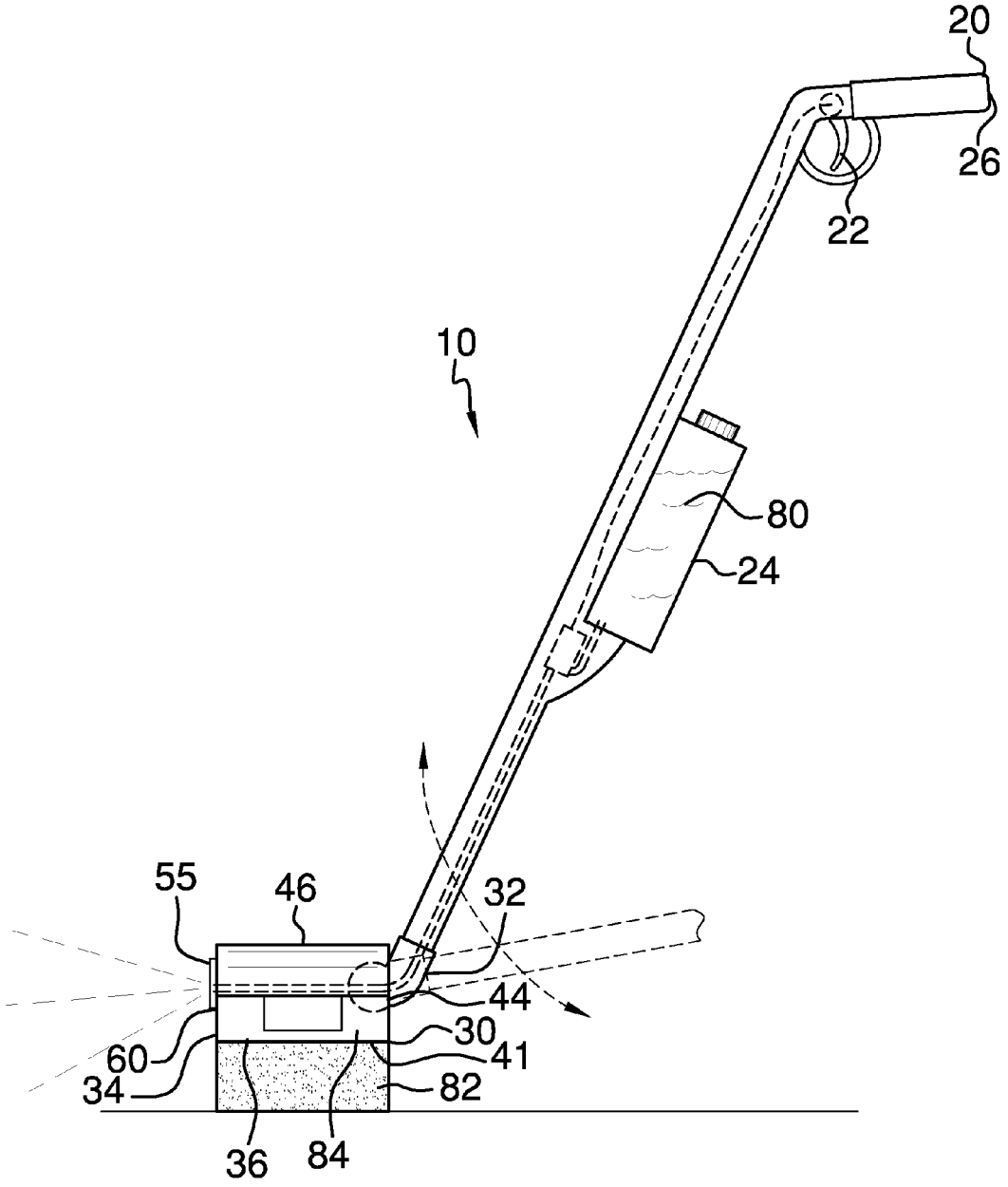
FIG. 5 is a side elevation view.

With reference now to the drawings, and in particular FIGS. 1 through 5 thereof, example of the instant mop with locking clamp employing the principles and concepts of the present mop with locking clamp and generally designated by the reference number 10 will be described.

Referring to FIGS. 1 through 5 a preferred embodiment of the present mop 10 is illustrated. The mop 10 includes a handle 20, a trigger 22 attached to the handle 20, and an impermeable container 24 attached to the handle. The trigger 22 can be disposed proximal to an outer end 26 of the handle 20 as illustrated. The impermeable container 24 is configured to contain a liquid substance 80, such as a cleaning solution.

The mop 10 further includes a cleaning head 30 swivelingly disposed on an inner end 32 of the handle 20. The cleaning head 30 has a base 34 having a first end 36, a second end 38 opposite the first end 36, a top side 40, a bottom side 41, a front side 43, and a rear side 44, and a protrusion 46 centrally disposed between the first end 36 and the second end 38 on the top side 40 of the base 34. A plurality of bristles 50 is continuously disposed on the bottom side 41 of the base 34. The bristles 50 are configured to permit a cleaning cloth 82 to removably cling thereto.

A spray nozzle 55 is disposed on the protrusion 46 on the front side 43 of the base 34. The spray nozzle 55 is in operational communication with the trigger 22 and the container 24. Activation of the trigger 22 releases a liquid substance 80, such as cleaning solution, into the spray nozzle 55 which, in turn, release the liquid substance 80 from the spray nozzle 55 onto a surface to be cleaned.

A lockable clamp arm 60 is pivotally attached to each of a first side 63 and a second side 64 of the protrusion 46 in parallel alignment with the first end 36 and the second end 38, respectively. Each lockable clamp arm 60 pivots from a closed position in which the lockable clamp arm 60 is in direct contact with the top side 40 of the respective first end 36 and second end 38 toward an open position in which the lockable clamp arm 60 is raised above the top side 40 of the respective first end 36 and second end 38. A notch 66 is continuously disposed on an exterior end 67 and a top wall 68 of each lockable clamp arm 60. A latch 70 is pivotally disposed within the notch 66 on each clamp arm 60. Each lockable latch 70 engages one of the lockable clamp arms 60 into the closed position. The latch 70 has an outside wall 72. A gripping surface 74 is disposed on the outside wall 72.

A plurality of spaced-apart teeth 76 is continuously disposed on the top side 40 of the base 34 on each of the first end 36 and the second end 38. A plurality of spaced-apart teeth 76 is also continuously disposed on a solid rectangular continuous bottom surface 77 of each lockable clamp arm 60. The teeth 76 can be disposed proximal to the perimeter of the first end 36, the second end 38, and each lockable clamp arm 60 as illustrated in the drawings. The latch 70 also allows a user to lift each lockable clamp arm 60 without contacting the teeth 76.

In use, the bristles 50 removably engage a cleaning cloth 82 having outer ends 84. The user raises the lockable clamp arms 60 into the open position. Each of the outer ends 82 wrap over the first and second ends 36, 38 of the base 34 and over the teeth disposed between the respective lockable clamp arm 60 and the respective first and second end 36, 38 of the base 34. The user then lowers the lockable clamp arms 60 into the closed position and locks engages the lockable clamp arms 60 with the latch 70 during use. The user sprays liquid substance 80 from the container 24 onto the surface to be cleaned by pulling the trigger 22 to release the liquid substance 80 through the spray nozzle 55 and spreads the liquid substance 80 to clean the surface with the cleaning cloth 82. The cleaning cloth 82 can be removed, cleaned, and reused on the device. The cleaning cloth 82 can also be formed of recyclable materials. When one of the cleaning cloths 82 can no longer be used due to wear and tear, the user replaces the worn cleaning cloth 82 with a new cleaning cloth 82.

What is claimed is:

1. A mop comprising:

a handle;

a cleaning head swivelingly disposed on an inner end of the handle, wherein the cleaning head has a base having a first end, a second end opposite the first end, a top side, a bottom side opposite the top side, a front side, and a rear side opposite the front side, and a protrusion centrally disposed between the first end and the second end on the top side;

a plurality of bristles continuously disposed on the bottom side of the base, wherein the bristles are configured to permit a cleaning cloth to removably cling thereto;

a lockable clamp arm pivotally attached to each of a first side and a second side of the protrusion in parallel alignment with the first end and the second end, respectively, each clamp arm having a solid rectangular continuous bottom surface;

wherein each lockable clamp arm pivots from a closed position in which the lockable clamp arm is in direct contact with the top side of the respective first end and second end toward an open position in which the lockable clamp arm is raised above the top side of the respective first end and second end; and a latch disposed on each lockable clamp arm, wherein each latch engages one of the lockable clamp arms in a closed position and alternately in an open position;

a plurality of spaced-apart teeth continuously disposed on the top side of the base on each of the first end and the second end; and a plurality of spaced-apart teeth continuously disposed on the bottom surface of each lockable clamp arm.

2. The mop of claim 1 further comprising a notch continuously disposed on an exterior end and a top wall of each lockable clamp arm;

wherein the latch disposed within the notch;

wherein the latch has an outside wall; and a gripping surface disposed on the outside wall.

3. The mop of claim 2 wherein the teeth are disposed proximal to the perimeter of the first end, the second end, and each lockable clamp arm.

4. The mop of claim 3 further comprising:

a trigger attached to the handle;

an impermeable container attached to the handle;

a spray nozzle disposed on the protrusion on the front side of the base, wherein the spray nozzle is in operational communication with the trigger and the container;

wherein the activation of the trigger releases a liquid substance, such as cleaning solution, into the spray nozzle which releases the liquid substance from the spray nozzle onto a surface to be cleaned; and wherein the trigger is disposed proximal to an outer end of the handle.

5. A mop comprising:

a handle;

a trigger attached to the handle proximal to an outer end thereof;

an impermeable container attached to the handle;

a cleaning head swivelingly disposed on an inner end of the handle, wherein the cleaning head has a base having a first end, a second end opposite the first end, a top side, a bottom side, a front side, and a rear side, and a protrusion centrally disposed between the first end and the second end on the top side;

a plurality of bristles continuously disposed on the bottom side of the base, wherein the bristles are configured to permit a cleaning cloth to removably cling thereto;

a spray nozzle disposed on the protrusion on the front side of the base, wherein the spray nozzle is in operational communication with the trigger and the container;

wherein the activation of the trigger releases a liquid substance, such as cleaning solution, into the spray nozzle which releases the liquid substance from the spray nozzle onto a surface to be cleaned;

a lockable clamp arm pivotally attached to each of a first side and a second side of the protrusion in parallel alignment with the first end and the second end, respectively, each clamp arm having a solid rectangular continuous bottom surface;

wherein each lockable clamp arm pivots from a closed position in which the lockable clamp arm is in direct contact with the top side of the respective first end and second end toward an open position in which the lockable clamp arm is raised above the top surface of the respective first end and second end;

a notch continuously disposed on an exterior end and a top wall of each lockable clamp arm;

a latch pivotally disposed within the notch on each lockable clamp arm, wherein the latch has an outside wall;

a gripping surface disposed on the outside wall;

a plurality of spaced-apart teeth continuously disposed on the top side of the base on each of the first end and the second end; and a plurality of spaced-apart teeth continuously disposed on a bottom surface of each lockable clamp arm.

6. The mop with lockable clamp arm of claim 1 wherein the teeth are disposed proximal to the perimeter of the first end, the second end, and each lockable clamp arm.

* * * * *